United States Patent [19]

Kerstein

[11] Patent Number: 4,991,914

[45] Date of Patent: Feb. 12, 1991

[54] MAIL SORTER BASKET FOR HANDLING MAIL TRAYS

[75] Inventor: Melvin Kerstein, Lincolnwood, Ill.

[73] Assignee: Bell & Howell Co., Skokie, Ill.

[21] Appl. No.: 453,134

[22] Filed: Dec. 12, 1989

Related U.S. Application Data

[63] Continuation of Ser. No. 199,372, May 26, 1988, abandoned.

[51] Int. Cl.[5] ..... A47B 88/00

[52] U.S. Cl. ..... 312/319; 312/333; 211/10

[58] Field of Search ..... 312/319, 333, 119, 118, 312/122; 209/900

[56] References Cited

U.S. PATENT DOCUMENTS

| | | | |
|---|---|---|---|
| 450,925 | 4/1891 | Beck | 312/319 X |
| 1,200,362 | 10/1916 | Jones | 312/119 |
| 1,955,370 | 4/1934 | Snook et al. | 312/119 |
| 3,602,562 | 8/1971 | Radelfinger | 312/119 |
| 3,658,398 | 4/1972 | Abbate et al. | 312/333 |
| 4,749,242 | 6/1988 | Rechberg | 312/333 |
| 4,880,121 | 11/1989 | D'Elia | 209/900 X |

*Primary Examiner*—Joseph Falk

*Attorney, Agent, or Firm*—Laff, Whitesel, Conte & Saret

[57] ABSTRACT

A basket structure for supporting mail trays between varying elevations relative to a workplace supporting planar floor in cooperation with a mail sorting machine having a plurality of sorting bins disposed laterally in spaced relation along the horizontal axis of the sorting machine at a predetermined elevation. The basket structure is moveable between a storage position at a first lower elevation and an access position at a second higher elevation horizontally adjacent to the predetermined elevation of the bins whereby the mail in the bins can be readily moved by an operator between at least one of the bins to an adjacent at least one of the mail trays that is substantially horizontally aligned with the at least one bin.

1 Claim, 7 Drawing Sheets

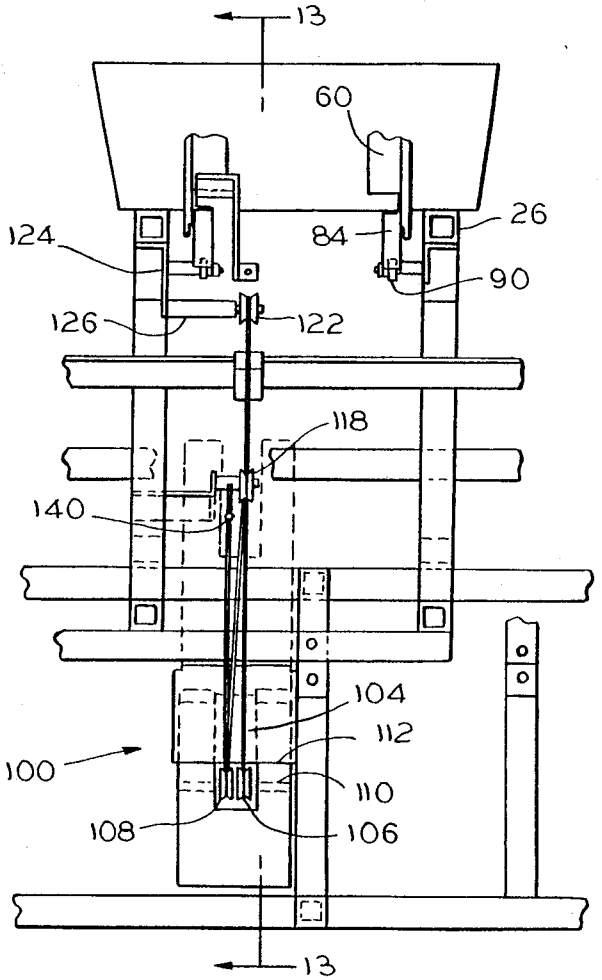
FIG. 14
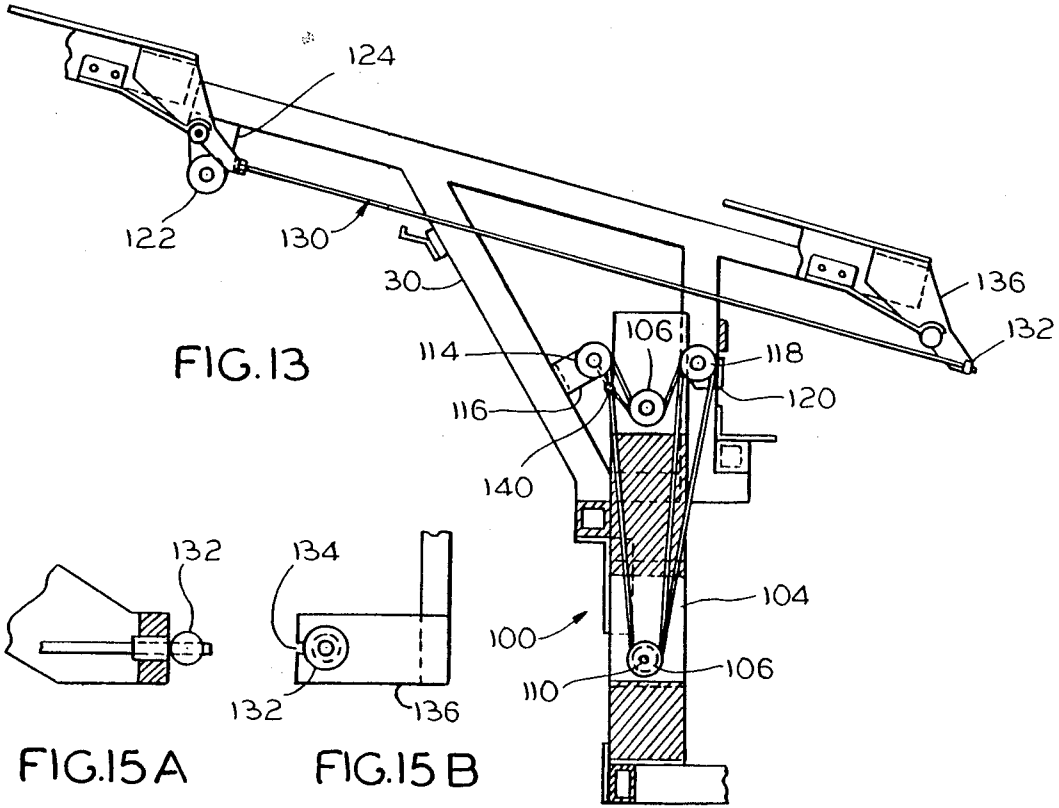
FIG. 13
FIG. 15 B
FIG. 15 A

MAIL SORTER BASKET FOR HANDLING MAIL TRAYS

This application is a continuation, of application Ser. No. 07/199,372, filed 5/26/88, abandoned.

FIELD OF THE INVENTION

This invention relates to the field of small package or envelope handling and more particularly to devices which will temporarily store a plurality of envelopes in a mail tray at one level and provide the movement of such a tray to a second level above the supporting floor to permit convenience in handling envelopes or other documents being deposited therein.

BACKGROUND OF THE INVENTION

In the field of mail sorting devices there has been a dramatic and rapid development of technology in the areas of identification of mail by application of indicia means, such as bar codes, to the envelopes and then reading such bar codes for purposes of identification and sorting based on such bar codes. A more recent development are the character scanning devices which read typewritten names and addresses, refer to a computer having a compilation of nationwide zip codes which can be fed to a bar code printer for application to the particular envelope just read by the scanning device. The bar code then permits sorting by postal facilities not having such a character scanning device.

Each of these forms of sorting, based on scanning characters or on reading a bar code, results an explosive amount of mail being handled on a rapid basis. The sorting mechanisms, which react to the information developed by scanning of either characters or bar codes, have been utilized for a long period of time and do a remarkable job in routing mail into designated bins which accomodate mail from one or more zip code areas. Unfortunately, it is necessary to constantly empty such bins and place the sorted mail into paperboard or plastic mail trays which can then be forwarded to the appropriate sub-stations.

Previously, the mail in such bins had to be manhandled or carried to an adjacent bench or table and placed in mail trays located on top of such benches or tables. When such a tray is resting in the horizontal mode the mail has a tendency to either slide down in front of the stack from the bin or alternatively to fall over, face down. In either event the operator must correct the orientation of the lead envelopes and then place the next stack into position within the tray. Thus, there were great time lags in walking back and forth between the sorter and tables carrying the mail trays, or alternatively, orienting the lead documents in the tray before being able to add to the stack.

SUMMARY OF THE PRESENT INVENTION

A primary object of the present invention is to reduce the time factor in handling of sorted envelopes between the sorting bins and the mail trays normally utilized for forwarding of partially sorted mail between substations.

Another object of the present invention if to provide means for moving a basket, adapted to carry mail trays, between at least two levels, namely, a first storage position located beneath a lateral portion of a sorting machine without interfering with the normal operation of the sorter; and a second position where the contents of the basket are readily accessible and are positioned adjacent to at least one of said sorting bins so that the operator loses no time in moving mail from one of said sorting bins into the mail tray carried by the preferred basket.

A further object of the present invention is to provide a slide means carrying the basket between such plurality of position levels and includes detent means for restraining the basket in such predetermined levels, either closed or accessible, and includes additional means for counterbalancing the weight of the basket to thereby reduce operator fatigue as well as to reduce the size of detent required to strain the basket in the predetermined level.

Still another object of the present invention is to permit the joining of several of such basket means into a module whereby plurality of such basket means are provided adjacent to at least one of said sorter bins to facilitate ready transfer of envelopes between the two.

Other and further objects will become apparent to skilled in the art when the attached specification is read in conjunction with the attached drawings.

BRIEF DESCRIPTION OF THE DRAWING

FIG. 13 is an abbreviated schematic side elevation, similar to FIG. 12, showing the counterbalance mechanism in the lowered position when the basket is in its extended position, taken along line 13—13 in FIG. 14;

FIG. 14 is a partial end view of the counterbalance mechanism as viewed from the left end of FIG. 13; and FIGS. 15A and 15B are partial sectional views of the ballshaped cable ending utilized to engage a slotted aperture in a bracket mounted on the forward end of the basket slide means.

DETAILED SPECIFICATION

Figure 1:
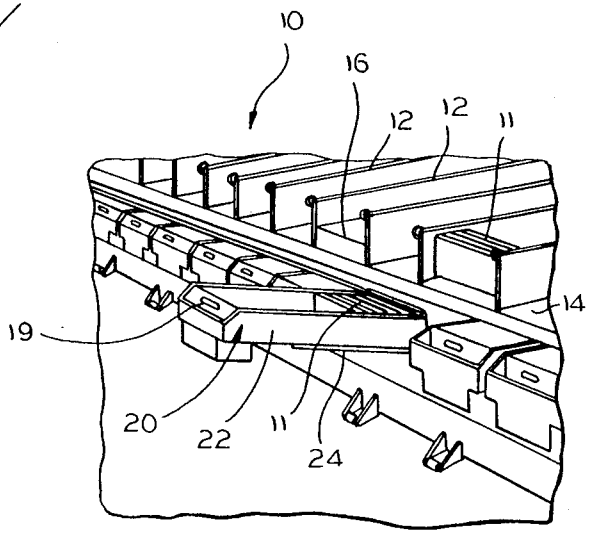
FIG. 1 is a partial schematic perspective view of a portion of a mail sorting device showing sorting bins positioned in adjacent relationship and having moveable basket means of the type contemplated by the present invention positioned therebelow, with one such basket being shown in the extended position.
Figure 2:
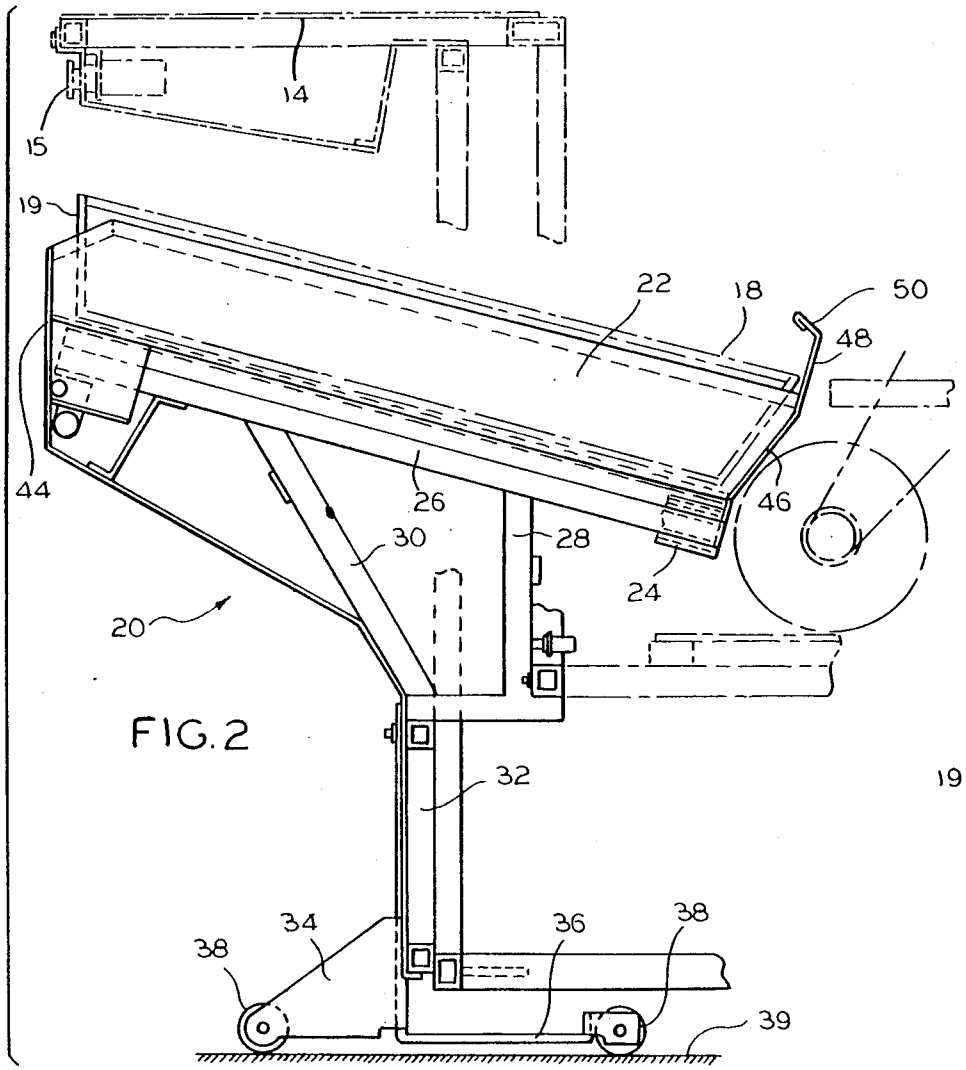
FIG. 2 is a side elevational view, in partial section, showing a sliding basket of the type contemplated by the present invention, shown in its stored position beneath the upper planar level of the sorting bins.
Figure 6:
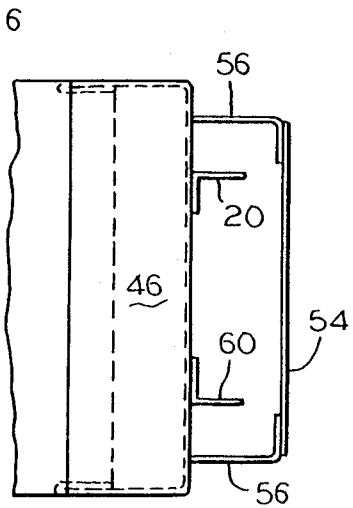
FIG. 6 is a view of the opposite end taken along line 6—6 of FIG. 5.

Referring now to the drawing, wherein similar parts are designated by similar numerals, the sorter section 10 will normally include a centrally disposed power means for movement of the envelopes along with a plurality of gates, both of which are not shown, for diverting mail 11 into a plurality of laterally extending bins formed by spaced upright wall means 12 that extend up from a generally planar table means 14. The table 14 often includes one or more slots accomodating belt means, not shown, for moving the mail laterally from the centrally disposed gates.

One such advanced sorting device with which the present invention has been used, includes a feeding mechanism for separating and advancing individual pieces of mail for presentation to a character scanning device where up to four lines of address are read and fed to a computer having a data base including all of the zip codes for the entire nation. The computer assigns a zip code to the individual piece of mail which is advanced to a printer mechanism for imprinting a bar code on the face of the envelope in accordance with the assigned zip code. The envelope then proceeds past a bar code reader device for checking the bar code imprinted thereon and if correct it proceeds to the sorter where it is sorted on the zip code first selected by the character reading device from the computer data bank. Since there must be a brief interval given to permit checking the data bank and assignment of a particular zip code, as well as imprinting the bar code, drying the ink from the imprinting operation, and checking the bar code for accuracy, the conveyor frame utilized can exceed 100 inches in length. The sorting modules are in excess of 90 inches in length and it is not uncommon to combine two or more souch sorter modules. Thus, it will be seen that such devices require large facilities for their use and operation.

Since the tote trays utilized in moving segregated mail are substantially larger than the envelopes per se, it will be recognized a problem arises when it is attempted to match modules of tray baskets with modules of sorter bins. There are normally eight (8) mail bins in a sorter section, while there are only 7 baskets acceptable spacewise with a comparable section. Therefore mail bin #5 is generally designated a dead mail bin—no letters go in this bin—and its gate is permanently closed. Often a raised member 16 will physically block the bin and prevent its use.

The preferred embodiment of the present invention is generally designated by the numeral 20 and includes a basket 22 carried by a slide means 24 afixed to an angled channel member 26 suitably supported by the upright L-shaped frame element 28, brace element 30, and main frame support 32. In the modular format the main frame support 32 is affixed at spaced points to a supporting bracket 34 that includes a rearwardly directed element 36 that with the bracket 34 provide yoke means for accepting the axles of spaced caster means 38, which rest on the supporting floor 39. The basket 22 is configured in shape and size to readily accept the normal mail tote tray 18.

Figure 5:
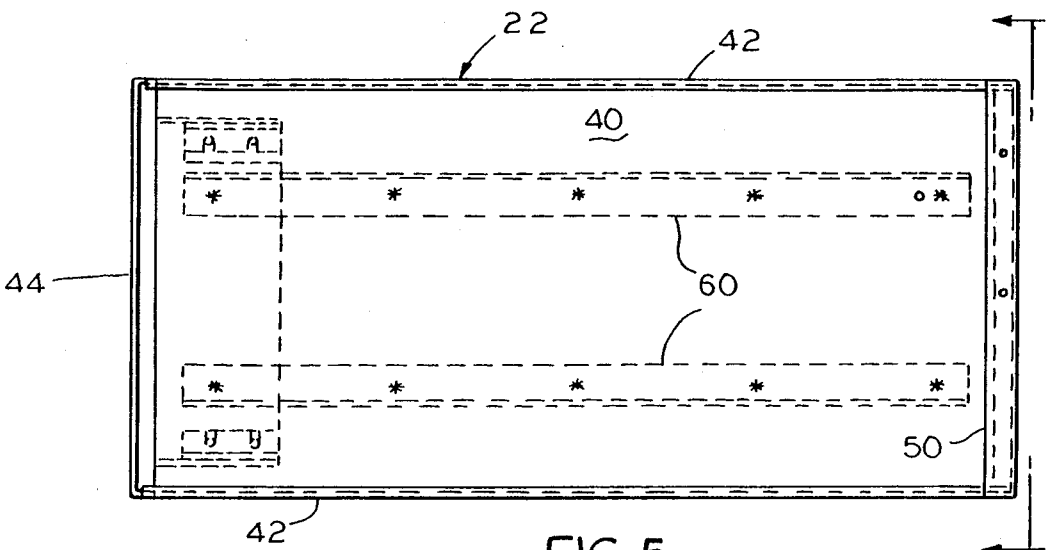
FIG. 5 is a top plan view of the basket shown in FIG. 3.
Figure 3:
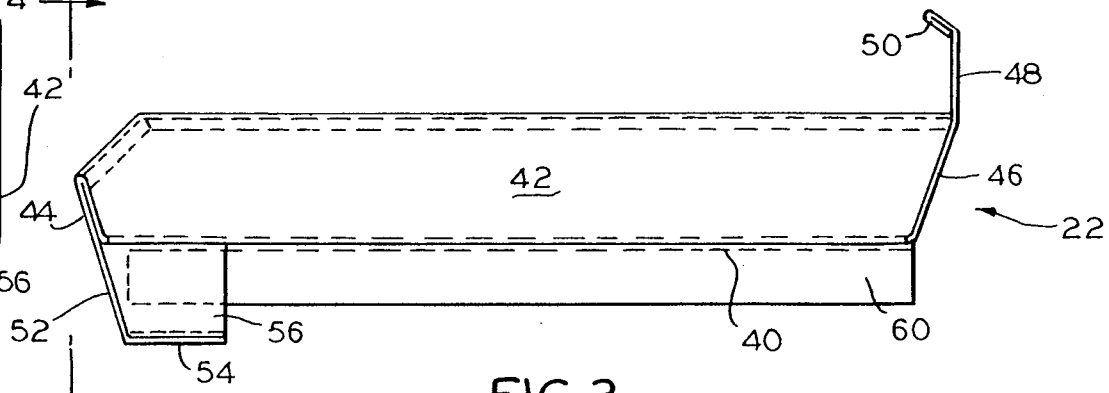
FIG. 3 is a side elevational view of a basket forming an integral part of the present invention.
Figure 4:
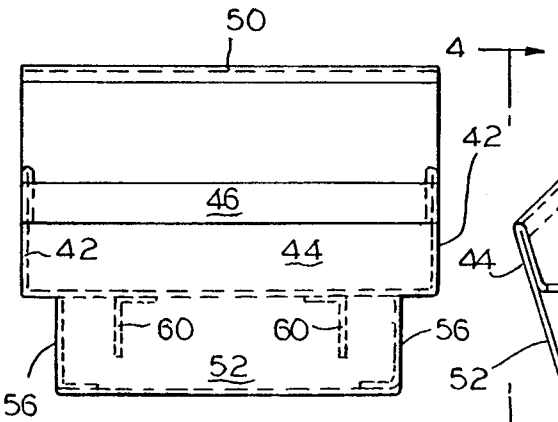
FIG. 4 is an end view of the basket taken along line 4—4 of FIG. 3.

Referring now to FIGS. 3 through 5, the basic basket 22 includes a planar base member 40, a pair of opposite side walls 42, a shallow end wall 44 at one end and an extended height end wall 46 at the opposite end. End wall 46 also has a side-to-side extension 48 plus a reversely bent lip 50, for purposes best set forth hereinafter. At the opposite end, the shallow wall has a downwardly depending extension 52 with an underlying strip 54 extending rearwardly from extension 52 parallel to but spaced from the base 40. End caps 56 complete the aesthetics of this integral cap, the primary function of the cap is to cover a pair of axially extending downwardly projecting L-shaped flanges 60 that have a length slightly less than the base plate 40. The flanges 60 form the basis of support with the slide means 24 described in more detail hereinafter. It should be noted, that the shallow end wall 44 permits ready gripping of the hand hole 19 in the mail tote tray 18.

Figure 7:
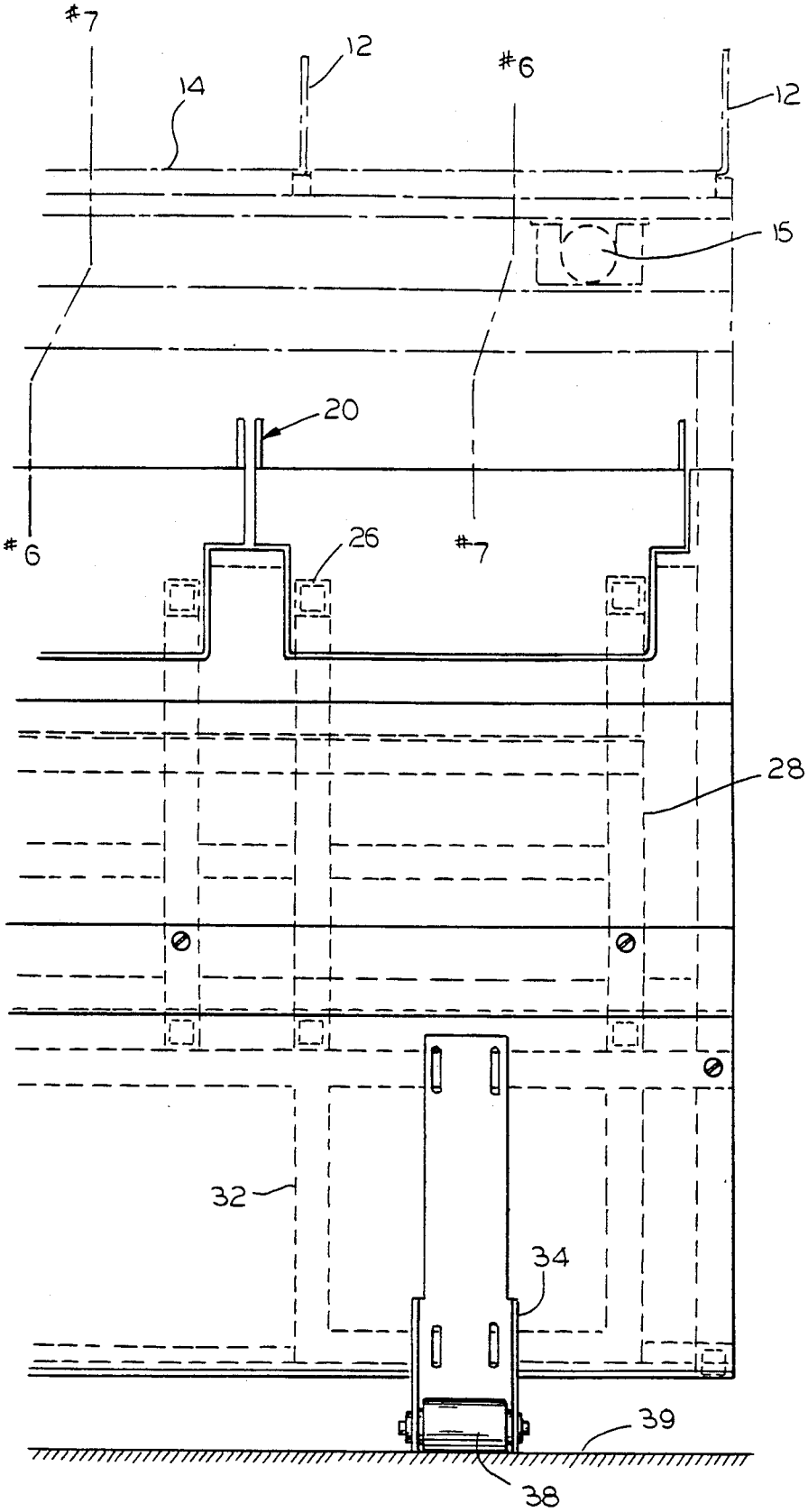
FIG. 7 is a schematic front elevational view generally showing the relationship between a pair of baskets for holding mail trays, in modular form, relative to sorting bins disposed thereabove.

Referring now to FIG. 7, this schematic figure illustrates how the centerlines of the bins are generally offset from the centerlines of the sliding basket means. In the schematic illustration, bin #7 is paired with basket #6, while bin #8 is paired with basket #7. Item 15 which appears in various figures represents one of a plurality of safety switches which are positioned along the various modules of the sorter for emergency shut downs in case of major jams or other difficulties.

Figure 8:
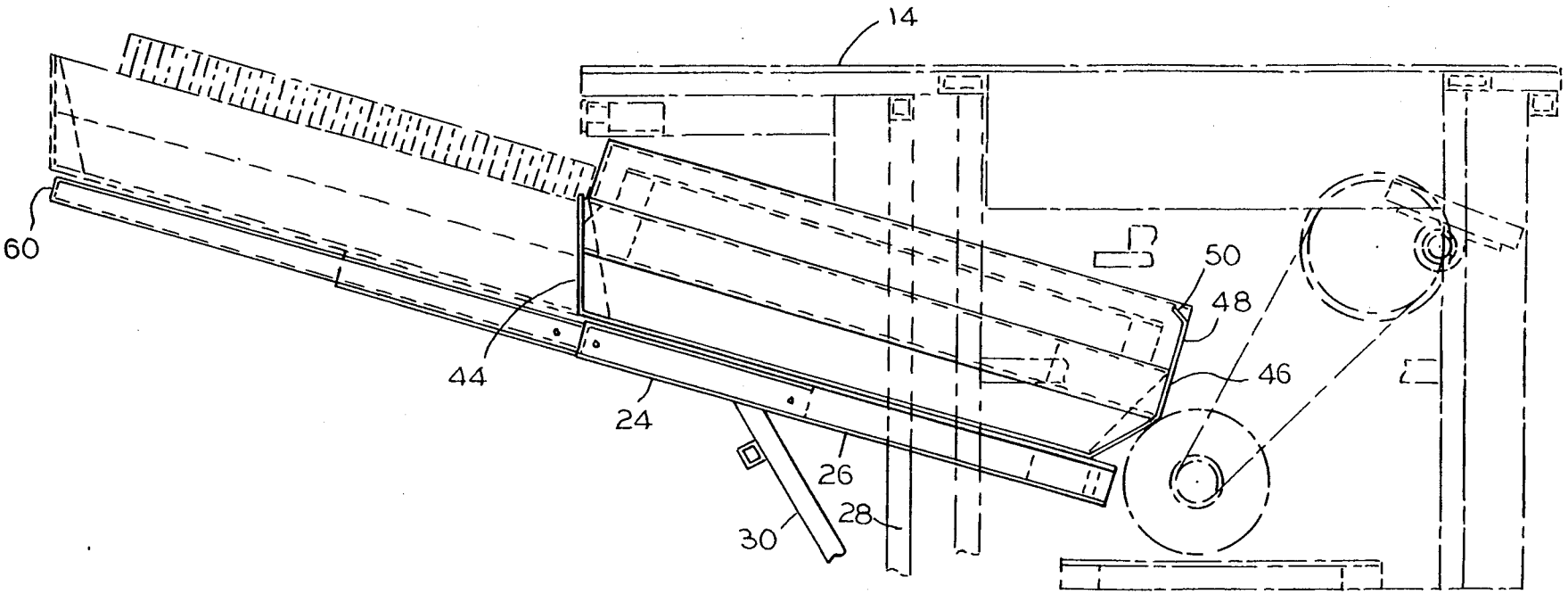
FIG. 8 is a schematic side elevational view, in partial section showing the basket and its related slide element in its closed and extended positions, as well as showing the relationship to the plane of the sorting bins.
Figure 9:
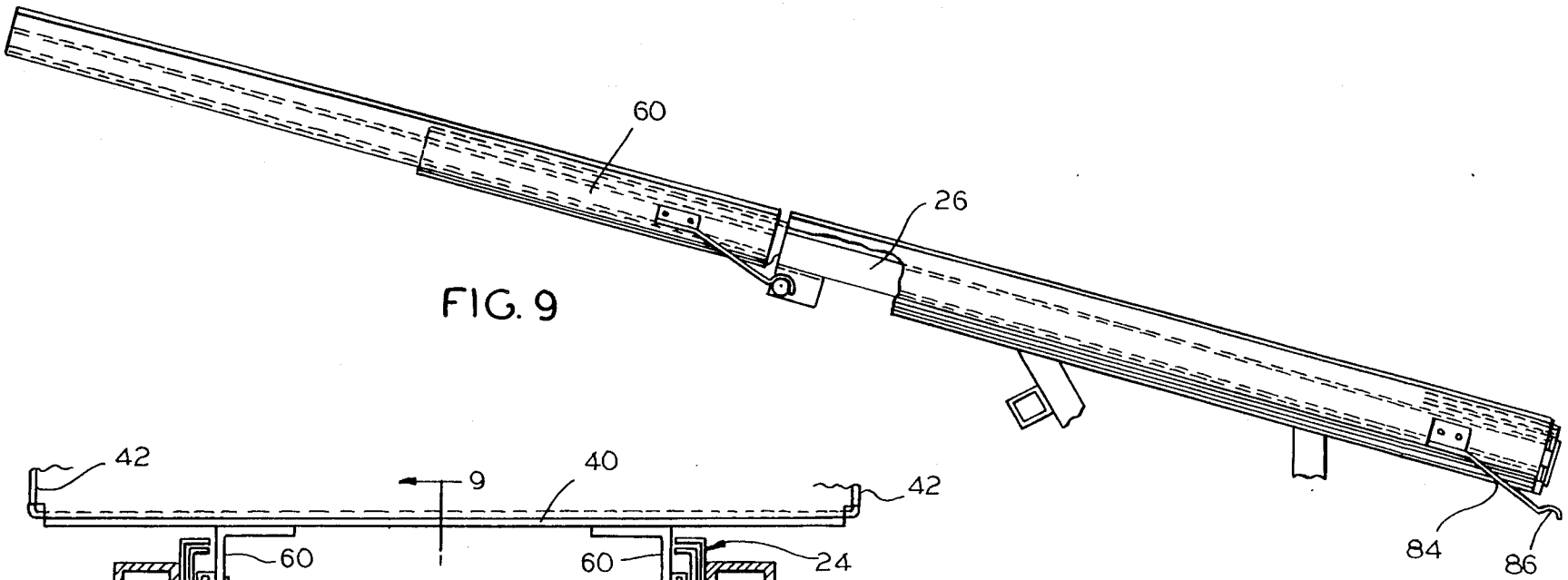
FIG. 9 is a side elevational view in partial section showing the two extreme positions of one side of the slide mechanism as well as showing the detent mechanism, taken along line 9—9 in FIG. 10.
Figure 10:
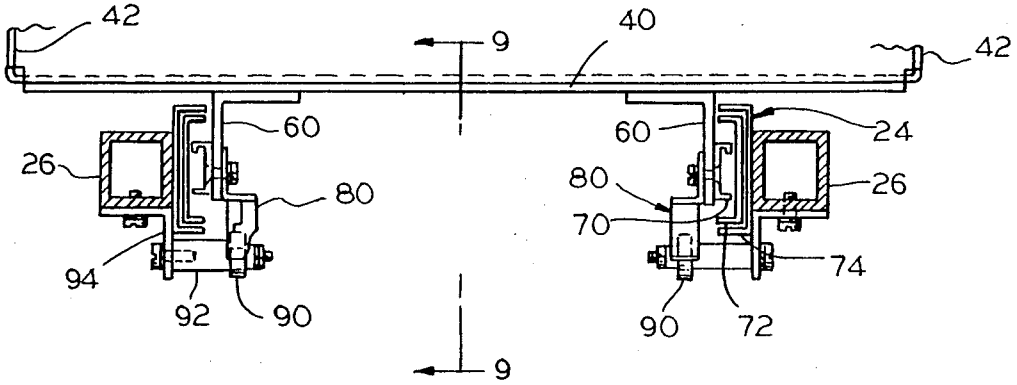
FIG. 10 is an end view, in partial section, of the basket including its lower brackets mounted on the nested slide mechanism that is attached to the adjoining frame members, and showing an end view of the spring detent members.
Figure 12:
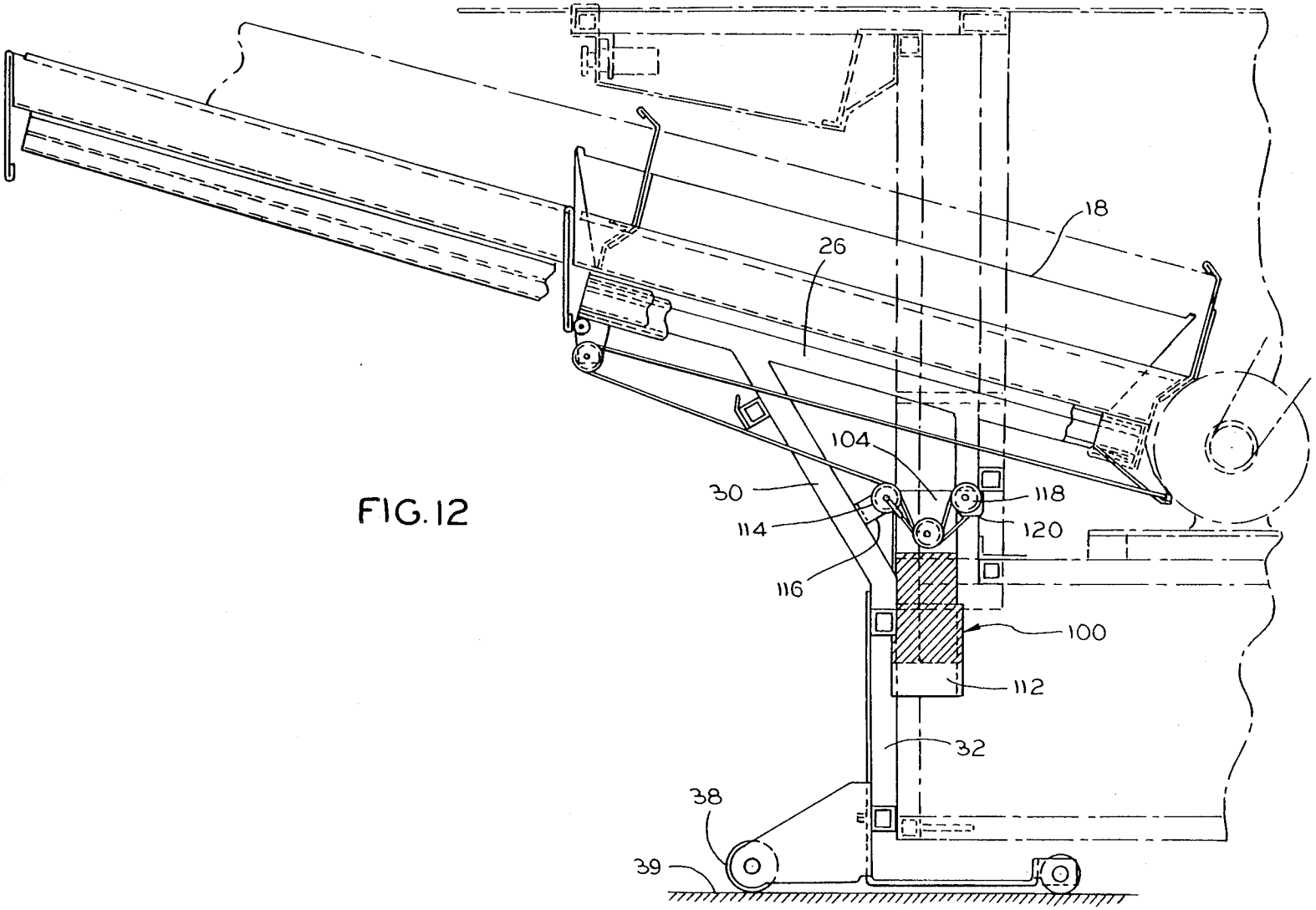
FIG. 12 is a schematic side elevation of the counterbalance mechanism shown in the elevated position when the basket is in its stored position.

In FIGS. 8–10 is illustrated the nesting slide means 24. The slide means 24 is illustrated with three internesting channels 70, 72 and 74 that may include, if desired, bearing or wheel means for friction reduction, not shown. The inner channel 70 is mounted on the exterior surface of flanges 60 and through the support of channels 72 and 74, the latter being afixed to the beam member 26, which permits the extended position of the basket 22 shown to the left in FIG. 8.

Figure 11:
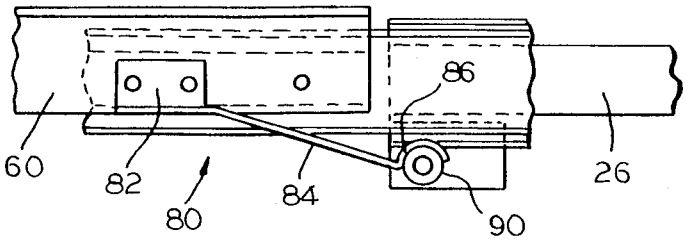
FIG. 11 is a partial enlarged detail of the detent mechanism shown in FIGS. 9 and 10.

As best seen in FIGS. 10 and 11, the device includes a detent mechanism 80 having a spring metal bracket 82 mounted on flange 60 and an integral extended spring arm 84 provided with a cammed detent recess 86 at its free end. Preferrably, the recess 86 is complimentary to a rotatable cylindrical bearing 90 supported on a spacer 92 mounted on bracket 94 afixed to beam 26. In the preferred embodiment there is a detent bearing 90 located at opposite ends of frame 26 so that the sliding basket 22 is restrained at both ends of its travel.

Thus, when a bin approaches being filled up with mail 11 an operator will pull out a basket 22 to its extended position, shown in FIGS. 1 and 8, and with both hands grab a major portion of the stack of mail 11 in a bin and move it laterally and downwardly into the waiting mail tote tray 18. It will be noted that the inclined rails 24 and supporting beams 26 bring the basket 22 to a proper height for preventing undue back strain on the operators. Also, the operators do not have to bend over to remove the tote trays 18 from the baskets or drawers 22 since they are approximately at waist level.

An important feature of the inclined or slanted disposition of the baskets 22 carrying the trays 18 is the fact that when the operator places the mail in the tray the leading envelope remains in an upright position. When the trays were previously in a horizontal position on a table or bench, the leading or front envelope in a stack of mail placed in a tote would either slide down into a flat horizontal position or else flip over into an upside down position. In either event it was necessary for the operator to lift up this last piece of mail and attempt to hold it in proper position when adding additional mail to the stack in the particular tote tray. In the present inclined disposition this problem is resolved and this loss of labor time is eliminated along with the operator frustration that came from this problem.

When a mail tote tray 18 is filled with mail it weighs approximately 13.9 pounds. In order to overcome operator fatigue from encountering variations in such weight every time they open a basket by pulling it into extended position, the preferred embodiment of the present invention includes a counterbalancing mechanism 100 including a weight 102 slotted at its top as at 104 with a pair of independently rotatable pulleys 106, 108 mounted in the slot 104 on an axle 110. The weight 102 is guided in vertical gravity-affected movement by a bracket 112 mounted on support beam 32. Adjacent the uppermost movement of weight 102, a pair of pulleys 114 and 118 are supported, with their grooves in inline relation to the pulley 106 and are capable of being accepted within slot 104, by means of brackets 116 and 120, respectively. A last pulley 122 is mounted on bracket 124 via spacer 126 from beam 26 adjacent the location of the upper end of basket 22 when it is in the retracted position.

A cable assembly consisting of a cable 130 having a ball shaped enlargment 132 accepted within a slotted aperture 134 formed in elongated angle bracket 136 attached to the lower or front end of basket 22. The cable 130 extends backward around pulley 122, back to pulley 114, down to pulley 106, up to pulley 118, down around pulley 108 and up to a fixed hook 140 where cable 130 terminates. Thus, movement in the drawer causes movement in the weight to counterbalance the weight of the basket 22 and the tray 18 with its load of letters 11. The detents 80 insure the maintenance of the drawer in its fully extended position as well as in its innermost position with the weight at its highest point.

Other embodiments and variations will be apparent to those skilled in the art but it is my intent to only be limited by the appended claim and their mechanical equivalents.

I claim:

1. A sliding basket means for storage of mail trays including primary support structure for maintaining said basket means in a plurality of positions relative to a generally planar work surface and adapted to be accepted in a semi-concealed manner relative to another surrounding structure, said basket means further including linear moveable support means, said linear moveable support means adapted for moving said basket means between a first stored condition within said primary support structure and a second open condition extending beyond said primary support structure whereby access to said basket means is readily available, means for altering the elevation of the basket means relative to said surrounding structure to thereby facilitate transfer of mail between an upper surface of said surrounding structure and said mail trays located in said basket means;

said elevation altering means including an inclined slide means;

said slide means including a plurality of nested sections that carry said basket means and permit its movement a distance substantially equal to its own length;

said slide means further including detent means to restrain said basket means in at least two positions;

said basket means including a counterbalancing means to assist said detent means in maintaining said basket means at predetermined selected positions, as well as assist the operator in moving said basket means along the incline of said slide means between said first stored condition and said second open condition;

said counterbalancing means including a vertically moveable weight carrying a centrally disposed double pulley in a cutout portion of said weight, a pair of fixed pulleys positioned adjacent the upper path of said weight, a fixed hook adjacent one of said fixed pulleys, a third fixed pulley spaced from said first two pulleys and the path of said weight and said third pulley being fastened to a bracket mounted on the support carrying said slide means, cable means connected at one end to the forward end of said basket means, passing around said third pulley and then winding around said two other pulleys and said double pulley with said other end of said cable means being affixed to said fixed hook means, whereby movement of said basket means along said slide means results in an elevation of said weight means be action of said cable means moving around said pulley means.

* * * * *